US005323600A

United States Patent [19]

Munshi

[11] Patent Number: 5,323,600

[45] Date of Patent: Jun. 28, 1994

[54] LINER STOP ASSEMBLY FOR A COMBUSTOR

[75] Inventor: Jonathan Munshi, Scotia, N.Y.

[73] Assignee: General Electric Company, Schenectady, N.Y.

[21] Appl. No.: 101,307

[22] Filed: Aug. 3, 1993

[51] Int. Cl.[5] ..... F23R 3/60

[52] U.S. Cl. ..... 60/39.02; 60/39.31

[58] Field of Search ..... 60/39.02, 39.31, 39.32, 60/752; 403/314, 367, 368

[56] References Cited

U.S. PATENT DOCUMENTS

| | | | |
|---|---|---|---|
| 2,795,108 | 6/1957 | Saldin | 60/39.31 |
| 2,944,766 | 7/1960 | Freeding et al. | 60/39.31 |
| 3,058,386 | 10/1962 | Morrow | 403/368 |
| 3,528,691 | 9/1970 | Matich, Jr. | 403/314 |
| 4,211,069 | 7/1980 | Kalbfuss | 60/39.02 |
| 4,283,028 | 8/1981 | Wilke | 60/39.31 |
| 4,471,623 | 9/1984 | Griffin | 60/39.31 |
| 4,643,609 | 2/1987 | Biass | 403/314 |
| 4,911,417 | 3/1990 | Short | 403/368 |
| 5,233,822 | 8/1993 | Ward et al. | 60/39.02 |
| 5,239,827 | 8/1993 | Havens | 60/487 |

FOREIGN PATENT DOCUMENTS

| | | | |
|---|---|---|---|
| 801739 | 9/1958 | United Kingdom | 60/39.31 |

*Primary Examiner*—Richard A. Bertsch
*Assistant Examiner*—Timothy S. Thorpe
*Attorney, Agent, or Firm*—Nixon & Vanderhye

[57] ABSTRACT

The liner stop assembly includes a flow sleeve stop, a liner stop, an adjuster, a lock plate and a bolt. The flow sleeve stop and liner stop have radial projections which axially butt one another upon insertion of the liner into the flow sleeve. The flow sleeve stop and liner stop have tapered surfaces which, in assembly, converge in a downstream axial direction for receiving complementary tapered surfaces on the adjuster. The adjuster includes lateral extensions for coarsely aligning the adjuster between the flow sleeve and liner stops. When bolt is screw-threaded in the tapped bore of the flow sleeve stop, the wedging action of the tapered surfaces of the adjuster and the flow sleeve and liner stops serves to radially adjust the liner relative to the flow sleeve.

3 Claims, 4 Drawing Sheets

LINER STOP ASSEMBLY FOR A COMBUSTOR

TECHNICAL FIELD

The present invention relates to a liner stop assembly for holding a liner against the inside of a flow sleeve in a combustor for a turbine and particularly relates to a liner stop assembly which minimizes or eliminates wear between the fuel nozzle and liner assembly cap.

BACKGROUND

Current liner stop assemblies are of two types: "loose-fitting" and "close-clearance." In the "loose-fitting" type, the mating parts of the stops are made with large clearances to avoid expensive post-weld machining and to render field assembly relatively simple. This, however, exacerbates fuel nozzle wear and liner stop distress. The wear can be so severe that nozzle tips require replacement with considerably frequency, for example, at every periodic inspection and at significant cost and expense. When "close-clearance" liner assemblies are employed, ease of assembly and low production costs are sacrificed to obtain a more reliable fuel nozzle-to-liner interface. Such high production costs and difficult assembly procedures thus dictate against use of "close-clearance" liner stop assemblies. In both cases, replacement of broken or worn stops cannot be accomplished in the field and require replacement at service sites where the broken stops are removed and new stops welded in place.

DISCLOSURE OF THE INVENTION

According to the present invention, the foregoing and other shortcomings of both "loose-fitting" and "close-clearance" types of liner stop assemblies are overcome and liner stop assemblies are provided which afford low production costs, minimal assembly difficulties, field assembly, extended hardware life and minimum maintenance. The liner stop assemblies of the present invention accurately space the liner and nozzle tip, thus eliminating or minimizing wear, eliminate expensive post-weld machining due to a self-adjusting feature, and compensate for mismatches between the flow sleeve and liner assembly and the fuel nozzle collar. Field assembly is simple and involves only the replacement of a broken or worn part with a new part. Additional benefits reside in reduced wear on other combustion parts, such as cross-fire tubes and Hula seals due to reduced movement of the liner.

In a preferred embodiment according to the present invention, there is provided a liner stop assembly for securing a liner and a flow sleeve in substantial axial alignment relative to one another and to a fuel nozzle in a combustor, comprising a flow sleeve stop for securement to the flow sleeve including a tapered surface and a radially inwardly extending projection having a tapped bore, the tapered surface and the projection being spaced axially from one another, a liner stop for securement to the liner and including a tapered surface and a radially outwardly extending projection axially spaced from one another, the projection having an opening therethrough in registration with the tapped bore in final assembly of the liner stop assembly, the tapered surfaces of the flow sleeve stop and the liner stop, in assembly, converging toward one another in an axial direction toward the projections, an adjuster having an axial opening and a pair of tapered surfaces along opposite sides thereof generally complementary to the tapered surfaces of the flow sleeve stop and the liner stop, respectively and a bolt, in final assembly, for passing through the adjuster and the opening in the liner stop projection for threaded engagement in the tapped bore of the flow sleeve stop whereby, upon insertion of the combustor liner axially into the flow sleeve, the liner stop projection engages the flow sleeve stop projection to prevent further axial movement of the liner and flow sleeve, and engagement of the tapered surfaces of the flow sleeve stop and liner stop by the respective tapered surfaces of the adjuster, affords radial adjustment of the flow sleeve and liner in response to threaded engagement of the bolt relative to the flow sleeve stop.

In a further preferred embodiment according to the present invention, there is provided a method of aligning a liner relative to a flow sleeve and fuel nozzle in a combustor comprising the steps of inserting the liner in an axial direction into the flow sleeve, abutting flow sleeve stops and liner stops carried by the respective flow sleeve and liner at circumferentially spaced positions thereabout to preclude further movement of the liner into the flow sleeve in the axial direction, advancing wedges between the liner stops and the flow sleeve stops to radially displace the liner and flow sleeve relative to one another to adjust the position of the liner relative to the flow sleeve and the fuel nozzle and locking the flow sleeve stop and liner stop at each circumferentially spaced position to one another to lock the liner in position relative to the flow sleeve and fuel nozzle.

BEST MODE FOR CARRYING OUT THE INVENTION

Reference will now be made in detail to a present preferred embodiment of the invention, an example of which is illustrated in the accompanying drawings.

Figure 1:
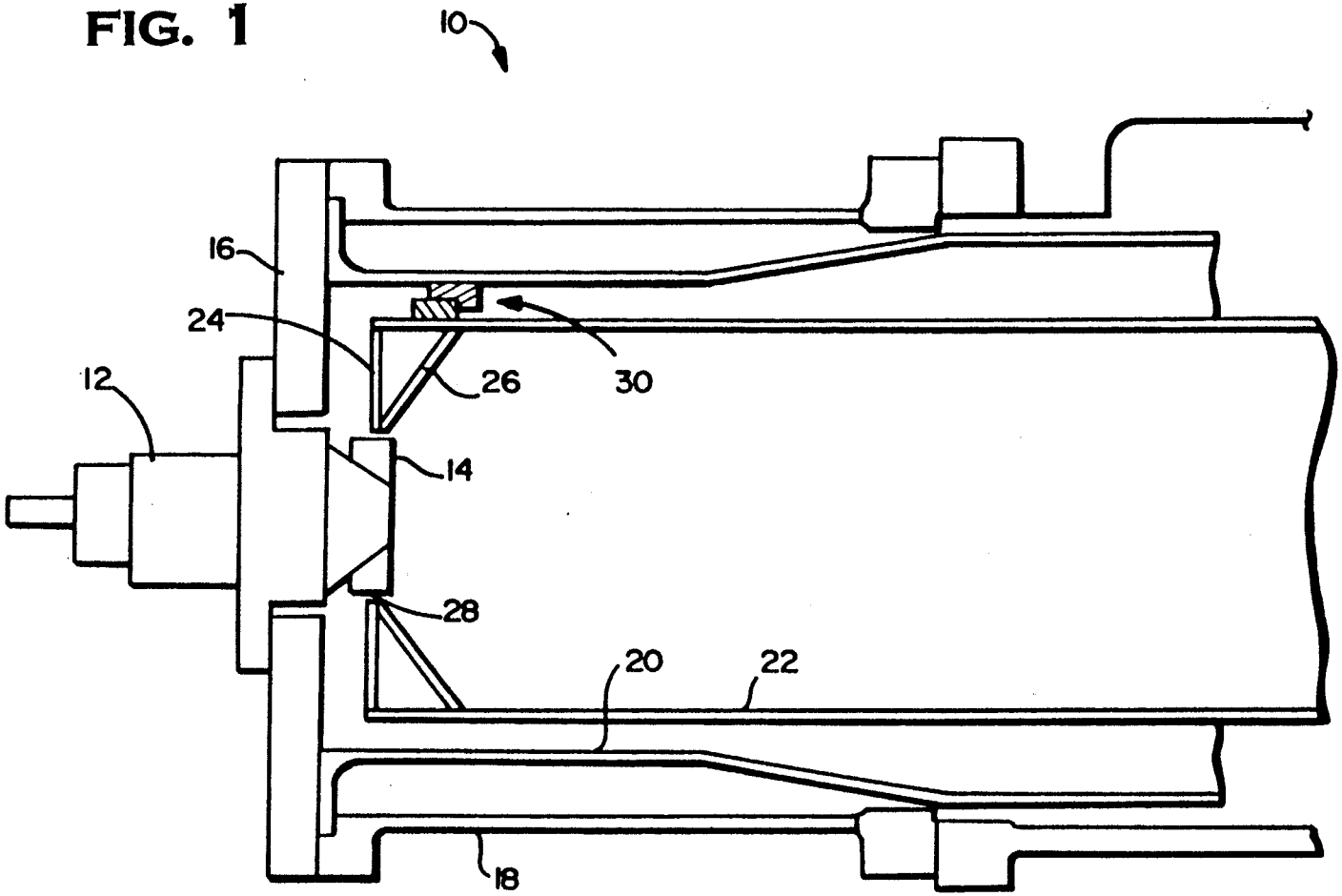
FIG. 1 is a schematic elevational view through the centerline of a combustor illustrating a liner stop assembly disposed between the liner and flow sleeve.

Referring now to the drawing figures, particularly to FIG. 1, there is illustrated a combustor, generally designated 10, having a fuel nozzle 12 with a surrounding fuel nozzle collar 14 mounted to an end plate 16 removably mounted on a combustor housing 18. Within housing 18 is a combustor flow sleeve 20 and a liner 22. As will be appreciated, flow sleeve 20 and liner 22 are generally cylindrical and extend generally axially from fuel nozzle 12 in a downstream flow direction. The liner 22 also includes a cap between it and nozzle collar 14, and which cap includes an annular end plate 24 and a conical disk 26, the cap forming a gap 28 in accordance with the present invention between the liner and fuel nozzle collar 14.

The liner stop assembly, according to the present invention, is generally indicated at 30 in FIG. 1. It will be appreciated that a plurality of such assemblies 30 are circumferentially spaced one from the other between the flow sleeve 20 and liner 22 to hold the liner against the inside of the flow sleeve to prevent it from moving too freely.

Figure 2:
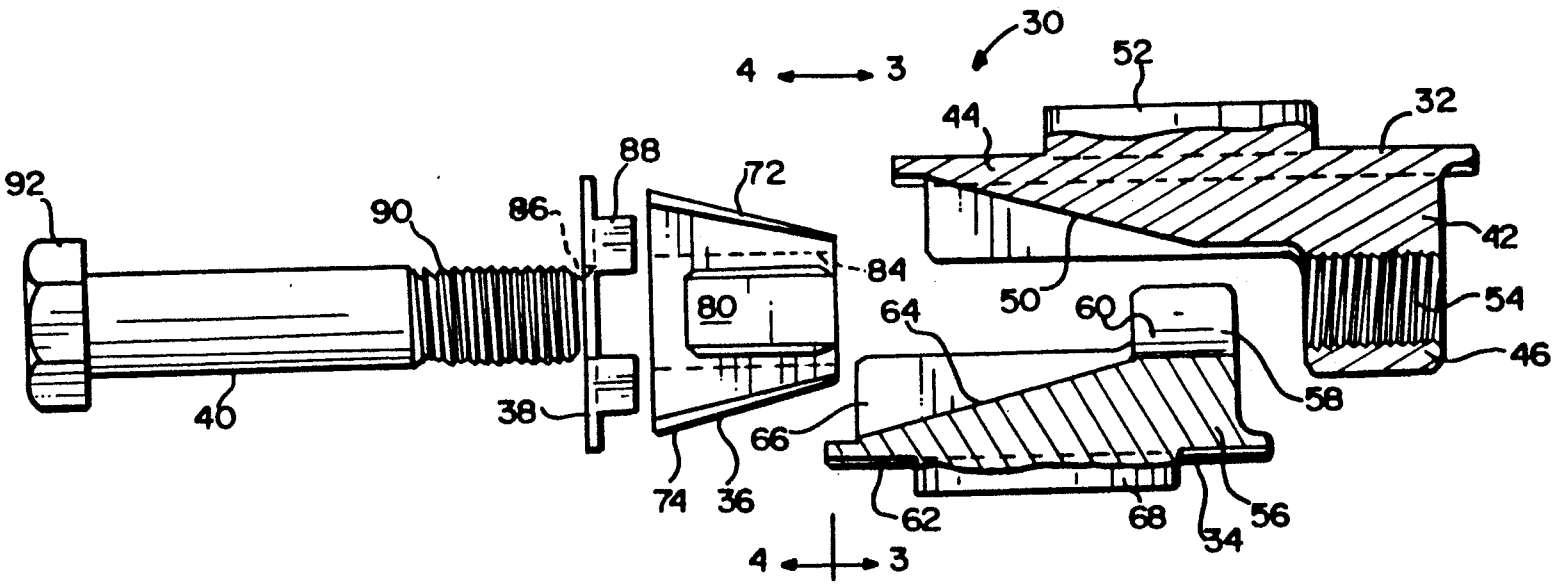
FIG. 2 is an enlarged cross-sectional view through the centerline of various parts forming the liner assembly hereof.
Figure 3:
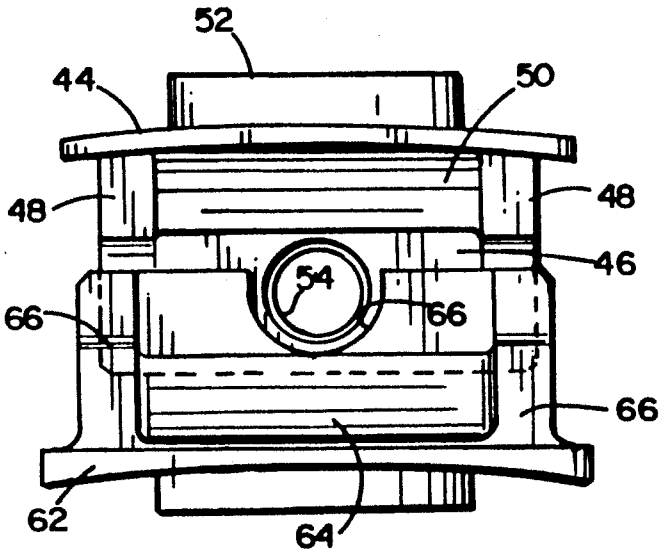
Figure 5:
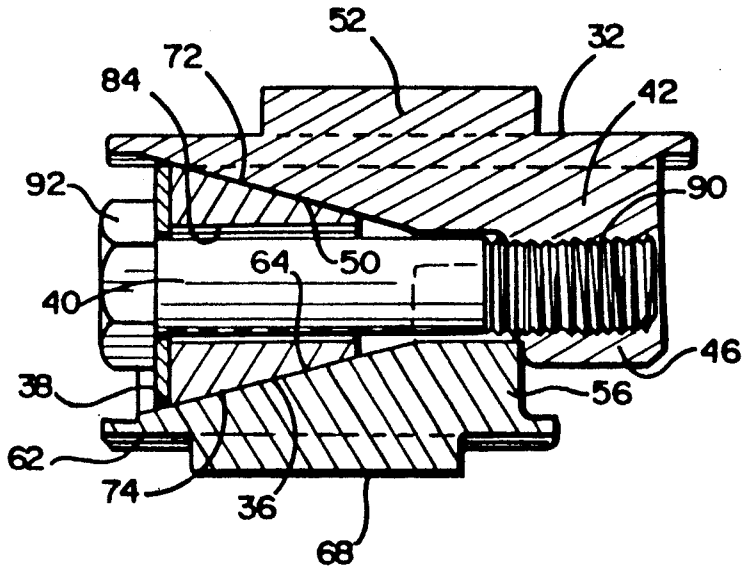
FIG. 5 is a longitudinal cross-sectional view of the liner stop assembly as finally assembled.

Referring to FIG. 2, liner stop assembly 30 includes a flow sleeve stop 32, a liner stop 34, an adjuster 36, a lock plate 38 and a bolt 40. Flow sleeve stop 32 includes a flow sleeve stop body 42 having a slightly arcuate plate-like section 44 (FIG. 3) with a flange or projection 46 extending generally radially inwardly from the downstream end of the flow sleeve stop 32. Body 42 also includes a pair of depending or generally radially inwardly projecting side flanges 48 spaced circumferentially one from the other and defining therebetween a tapered surface 50 converging toward the longitudinal axis of the combustor in a downstream direction. Extending from the radially outer side of plate 44 is a projection 52 which is received in a complementary opening in the flow sleeve such that flow sleeve stop 30 can be secured, e.g., by welding, to flow sleeve 20. Radially inwardly directed flange 46 includes a tapped bore 54.

Liner stop 34 includes a liner stop body 56 having at a downstream end a radial outward projection or flange 58 having a central arcuate opening 60 and a longitudinally extending arcuate plate-like section 62. The liner stop 56 includes a central tapered surface 64 converging radially outwardly in a downstream direction and a pair of radially outwardly projecting side flanges 66 straddling surface 64. Extending from the radially inner side of plate 62 is a projection 68 for reception in a complementary opening in the liner 22 and securement thereto, e.g., by welding.

Figure 4:
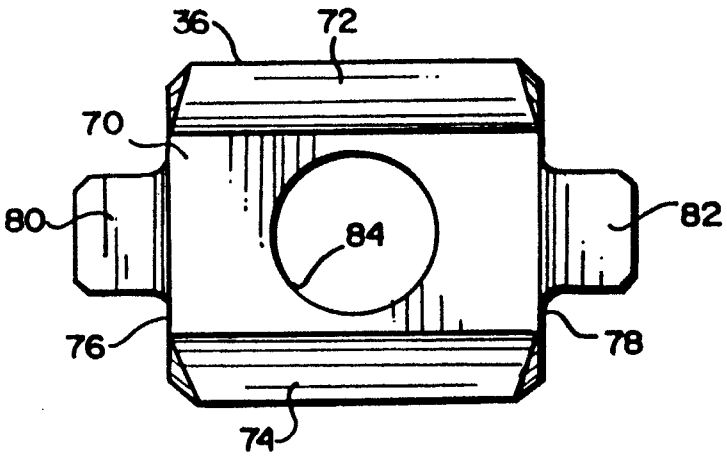
FIGS. 3 and 4 are cross-sectional views thereof taken generally about on lines 3—3 and 4—4, respectively, in FIG. 2.

With reference to FIGS. 2 and 4, adjuster 36 includes a generally rectangular body 70 having radially outer and inner generally flat tapered surfaces 72 and 74, respectively. Surfaces 72 and 74 are complementary in taper to the surfaces 50 and 64, respectively. Adjuster 36 has generally flat sides 76 and 78 from which extensions 80 and 82 project in a generally circumferential direction. Adjuster 36 also has a central bore 84 for receiving bolt 40.

Lock plate 38 is a generally rectangular plate having a central bore 86. A pair of tabs 88 project along one side of the lock plate 38 and are spaced from one another a distance greater than the width of the extensions 80 and 82. Bolt 40 is conventional in construction having a threaded end 90 for threaded engagement with the threads 54 of the tapped opening of the flow sleeve stop 32 and a head 92.

In use, the flow sleeve stop 32 and the liner stop 34 are secured at corresponding circumferentially spaced locations about the flow sleeve 20 and liner 22, respectively, prior to assembly of the liner into the combustor. This is preferably accomplished by welding about the projections 52 and 68 and the complementary openings in the flow sleeve 20 and line 22, respectively. Once secured, liner 22 is inserted through the end of the combustor, it being appreciated that the end plate and fuel nozzles are removed to enable the insertion of the liner 22, for example, from left to right, as illustrated in FIG. 1. The liner is inserted such that the end faces of the liner stop bodies 56 butt against the interior end faces of the projections 46 of the flow sleeve stops 32.

Once abutted in this coarse alignment of the liner and flow sleeve, the adjusters 36 are inserted axially into the wedge-shaped opening formed by the tapered surfaces 50 and 64 of the flow sleeve and liner stops, respectively. The extensions 80 and 82 extend between the flanges 48 and 66 along opposite sides of the stops 32 and 34 to provide additional coarse adjustment. The bolt 40 and lock plate 38 are then applied to the assembly, with the bolt 40 passing through the aperture 84 of the adjuster and the opening 60 of the liner stop 34 for threaded engagement in tapped bore 54. By loosely tightening the bolt 40, the adjuster 36 is drawn toward the stops 32 and 34 such that the tapered surfaces 72 and 74 engage the tapered surfaces 50 and 64, respectively, and thereby approximate the relative positions of the liner and flow sleeve in final assembly. By variously adjusting the adjusters 36 and bolts 40, the liner can be coaxially centered relative to the flow sleeve. When the bolt is tightened into final position, it will be appreciated that the tabs 88 of the lock plate 38 engage on opposite sides of an extension, for example, extension 80, to prevent unthreading action of the bolt relative to the flow sleeve stop. One or more tabs of the lock plate are also sent out of the plane of the lock plate to engage flats on the bolt head to complete locking. Thus, the cap is accurately centered relative to the fuel nozzle collar 14 to provide the required gap 28.

It will be appreciated that the adjuster affords an opportunity to center the liner in the flow sleeve without using "close-clearance" parts that require post-weld machining. Consequently, the assembly is less expensive to produce and may be assembled in the field. This ease of assembly and self-centering quality is maintained notwithstanding wear and tear on the combustor. Additionally, the adjuster may be formed as a sacrificial part by forming it from a softer material than the flow sleeve and liner stops 32 and 34, respectively. For example, the stops may be formed of 400 Series Stainless Steel, while the adjuster may be formed of a 300 Series Stainless Steel. Additionally, rather than entirely removing the liner and flow sleeve for service, the present design enables replacement of the adjuster in the field whereby the liner and flow sleeve can be realigned at minimal cost and with the additional advantage that the cap is spaced from the fuel nozzle, eliminating wear between those elements. Consequently, the fuel nozzle tips no longer require replacement with the same degree of frequency as was necessary with prior liner stop assemblies. Also, by holding the liner firmly against the flow sleeve, and inhibiting its free movement, other wear interfaces, such as the cross-fire tubes and Hula seals, have extended life expectancy in the combustor. While the stop assemblies hereof are preferably spaced 120° apart, necessitating three stops for each combustor, it will be appreciated that more than three stops may likewise be utilized as desired.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. A method of aligning a liner relative to a flow sleeve and fuel nozzle in a combustor comprising the steps of:

inserting the liner in an axial direction into the flow sleeve;

abutting flow sleeve stops and liner stops, carried by the respective flow sleeve and liner at circumferentially spaced positions thereabout, to preclude further movement of said liner into said flow sleeve in said axial direction;

advancing wedges between the liner stops and sleeve stops to radially displace the liner and flow sleeve relative to one another to adjust the position of the liner relative to the flow sleeve and the fuel nozzle; and locking the flow sleeve stop and liner stop another at each circumferentially spaced position to lock the liner in position relative to the flow sleeve and fuel nozzle.

2. A method according to claim 1 including differentially adjusting said wedges to coaxially align said flow sleeve and said liner.

3. A method according to claim 1 including advancing an extension carried by said wedge to coarsely adjust the relative radial locations of said flow sleeve and said liner before said wedges radially displace the flow sleeve and liner relative to one another.

* * * * *